United States Patent [19]

Bihler

[11] 4,167,239

[45] Sep. 11, 1979

[54] FEEDING APPARATUS FOR STEPWISE FEEDING OF CONTINUOUS ELONGATED MATERIAL

[76] Inventor: Otto Bihler, Sehleiferweg 2, D-8959 Halblech, Füssen, Fed. Rep. of Germany

[21] Appl. No.: 886,342

[22] Filed: Mar. 14, 1978

[30] Foreign Application Priority Data

Mar. 17, 1977 [DE] Fed. Rep. of Germany ..... 2711693

[51] Int. Cl.[2] ..... B65H 17/36

[52] U.S. Cl. ..... 226/150; 226/162

[58] Field of Search ..... 226/149, 150, 161, 162

[56] References Cited

U.S. PATENT DOCUMENTS 3,157,334 11/1964 Bunnell et al. ..... 226/150

3,523,632 8/1970 Shields ..... 226/162 X 3,583,268 6/1971 Scribner ..... 226/162 X

*Primary Examiner*—David A. Scherbel

*Attorney, Agent, or Firm*—Toren, McGeady and Stanger

[57] ABSTRACT

Continuous, elongated material is fed lengthwise in steps by clamping devices of which one is stationary on supporting structure, the other is reciprocated. Each device includes clamping jaws backed by a fluid-operated jack and return springs in such a manner that the stationary jack is spring-biased toward the clamping position, and the reciprocating jack is spring-biased toward the material-releasing position, both jacks being operated intermittently, against the restraint of the return springs by the simultaneously supplied pressure fluid. The return spring in the reciprocating jack is weaker than that in the stationary jack. The springs may be replaced by equivalent pneumatic devices.

10 Claims, 2 Drawing Figures

FEEDING APPARATUS FOR STEPWISE FEEDING OF CONTINUOUS ELONGATED MATERIAL

Figure 1:
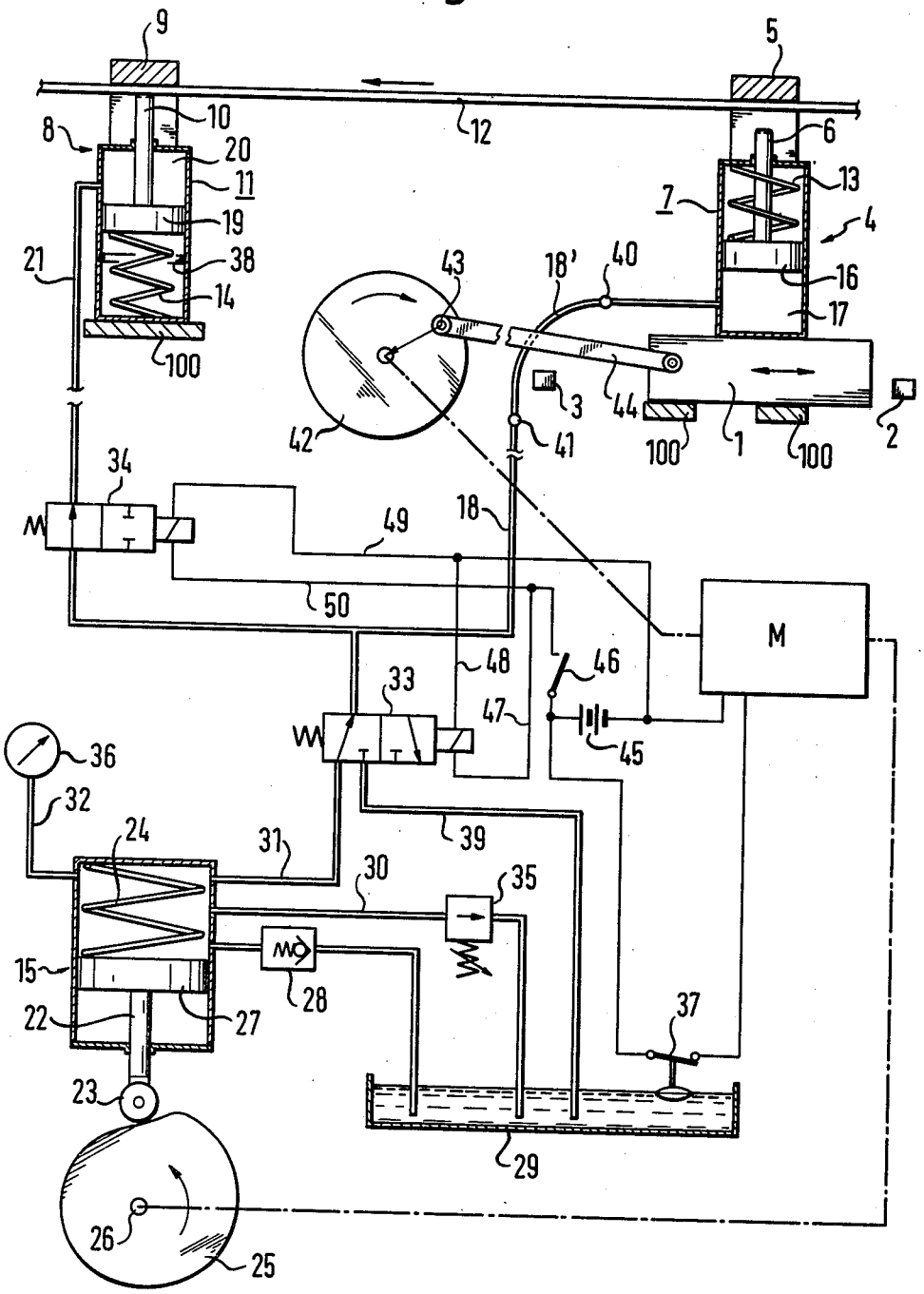

The invention relates to feeding apparatus for stepwise feeding of continuous, elongated material, and particularly to an improvement in the known basic type of feeding apparatus in which a continuous length of material is fed in a forward longitudinal direction during one stroke of a reciprocating clamping device and is prevented from moving backward during the other stroke by a stationary clamping device.

It is known to equip the clamping devices of known feeding apparatus with return springs which bias the jaws of each device toward a material-releasing position, and to shift the jaws into the clamping position by means of suitably synchronized cams. While the known feeding apparatus functions well when newly built, the cam arrangements are subject to wear and relatively expensive to maintain and to replace. The cam pressure is transmitted to the guides of the movable clamping device resulting in further wear.

The primary object of this invention is the provision of feeding apparatus which performs the functions of the afore-described known apparatus at least equally well when new, but is simpler in its structure and free from significant wear during extended operating periods.

With this object and others in view, as will hereinafter become apparent, the invention provides two clamping devices spaced on a support in a predetermined direction in which a slide carrying one of the devices is reciprocated. Each clamping device includes a base portion and an operating portion movable relative to the base portion between two terminal positions. One portion includes a cylinder member enclosing a cavity therein while the other portion includes a piston member movable in the cavity and bounding a compartment of the cavity. Respective clamping jaws secured to the cylinder and piston members clamp the material to be fed in one terminal position of the operating portion, and they release the material in the other terminal position. A common pressure fluid supply device is connected to the two compartments for cyclically supplying pressure fluid to the compartments and for shifting the operating portion of one clamping device into its one terminal position while shifting the operating portion of the other clamping device into the other terminal position thereof by the pressure of the supplied fluid. When the fluid pressure decreases to a first value, the operating portion of the one clamping device is shifted by a return arrangement from its one to the other terminal position. When the fluid pressure decreases to a second value different from the afore-mentioned first value, the operating portion of the other clamping device is shifted by a second return arrangement from its other terminal position toward the one terminal position. The reciprocating movement of the slide and the cyclic variation in the pressure of the fluid supplied are actuated in timed sequence.

Figure 2:
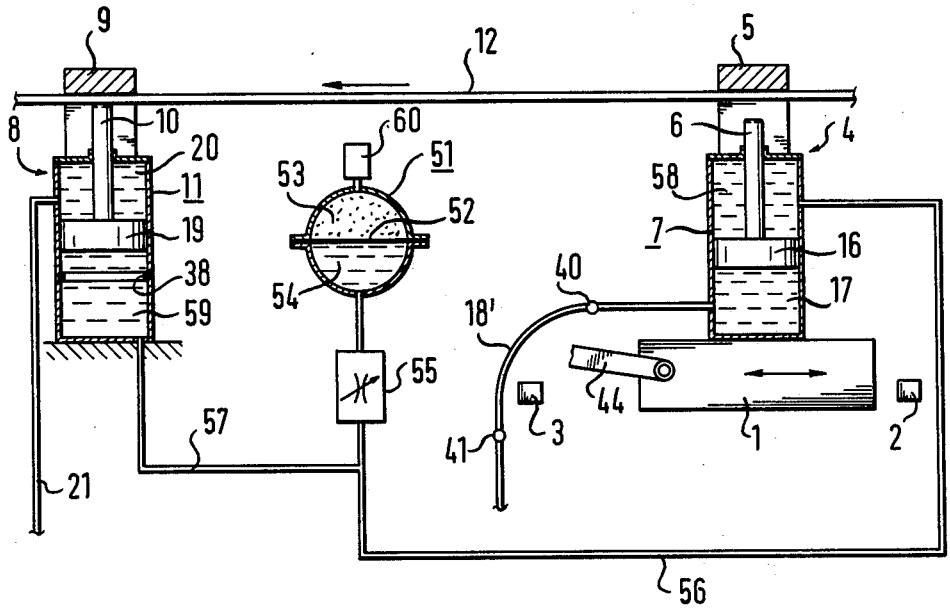

Other features, additional objects, and many of the attendant advantages of this invention will readily be appreciated from the following detailed description of preferred embodiments when considered in connection with the appended drawing in which:

FIG. 1 shows feeding apparatus of the invention in side elevational section and partly by conventional symbols; and FIG. 2 illustrates a modified portion of the apparatus of FIG. 1 in a fragmentary, corresponding view.

Referring now to the drawing in detail and initially to FIG. 1, there is shown only as much of a strip feeding apparatus as is needed for an understanding of the invention. As is conventional and not illustrated, metal strip 12 is to be unwound in continuous length from a storage reel and to be fed stepwise in a longitudinal direction to a stamping press of which only portions of a supporting frame 100 are shown.

A slide 1 is guided on the supporting structure for reciprocating movement parallel to the path of the strip 12, and its stroke is limited in both directions by fixed abutments 2, 3 on the machine frame 100. The slide 1 carries a clamping device 4 which is a single-acting hydraulic jack. Clamping jaws 5, 6 are mounted respectively on the cylinder 7 and the piston 16 of the jack 4, the jaw 6 being a rod axially guiding the piston 16 in the cylinder 7. The jaw or piston rod 6 is biased away from the other, anvil-shaped jaw 5 by a helical compression spring 13 in one of the two compartments of the cylinder cavity which are separated by the piston 16, the other compartment 17 being fluid-tight and connected with a piston pump 15 by a metal tube 18, a flexible hose 18', and other elements presently to be described.

The base portion of another clamping device 8, also a hydraulic jack, is a cylinder 11 in which a piston 19 is guided axially as the operating portion of the device by a piston rod 10. The piston rod functions as one jaw of the clamping device whose other jaw is constituted by an anvil 9 on the cylinder 11. The cylinder 11 is fixedly fastened on the machine frame 100. The annular compartment 20 of the cylinder cavity may be filled with pressure fluid through a tube 21 to shift the rod 10 away from the anvil 9 against the restraint of a helical compression spring 14 in the other cylinder compartment, the axial displacement of the piston 19 under the pressure of fluid in the compartment 20 being limited by abutment against an annular rib 38 on the inner cylinder wall before the several turns of the spring 14 axially engage each other.

The two jacks 4, 8 are identical except for the location of their fluid connections 18, 21 and of their return springs 13, 14. Also, the spring 13 is softer than the spring 14 and thus offers less resistance to the movement of the associated piston under equal force applied by pressure fluid. Additionally, the face of the piston 16 exposed to the pressure fluid in the compartment 17 is larger than the annular face of the piston 19 exposed simultaneously to equal fluid pressure in the compartment 20 during normal operation of the feeding apparatus.

The piston rod 22 of the pump 15 carries a cam follower roller 23 on its free end outside the pump cylinder, and the piston 27 attached to the inner end of the rod 22 is reciprocated by a radial cam 25 mounted on a shaft 26 during each revolution of the shaft which is driven by an electric motor unit M. A return spring 24 in the pump cylinder maintains engagement between the cam follower 23 and the cam 25. The working compartment of the pump cylinder in which the compression spring 24 is mounted communicates with an open sump 29 through a one-way valve 28 which opens to admit hydraulic fluid to the pump 15 if subatmospheric pressure should occur in the pump due to leakage losses or the like. The maximum pressure maintained in the hydraulic system by the pump 15 is limited by a pressure-relief valve 35 in a line 30 connecting the working compartment to the sump 29. A pressure gage 36 at the end of a pipe 32 provides a visual indication of the fluid pressure in the pump 15.

A two-way valve 33 is spring-biased toward the illustrated position in which it connects the output and intake conduit 31 of the pump 15 with the afore-mentioned tubes 18 and 21, the latter being provided with a shut-off valve 34. A float switch 37 deenergizes the motor unit M if the fluid level in the sump 29 drops below a desired minimum value. The motor unit M also turns a circular disc 42 about its axis once during each revolution of the cam 25. An eccentric, axial pin 43 hingedly fastens one end of a connecting rod 44 to the disc 42, the other end of the rod 44 being hinged to the slide 1 for reciprocating the same and the attached jack 7 as indicated by a double arrow.

A source of electric current, conventionally represented in FIG. 1 by a battery 45, is series-connected with the switch 37 and the motor unit M for energizing the latter when the switch is closed. Another switch 46 and conductors 47, 48, 49, 50 connect the current source 45 with solenoid actuators of the valves 33, 34 for simultaneously shifting the valves into their non-illustrated positions when the switch 46 is closed. The shifted valve 34 seals the fluid in the cylinder compartment 20 of the jack 8 regardless of the pressure prevailing in the pump 15, and the shifted valve 33 vents the cylinder compartment 17 of the jack 4 to the sump 29.

The apparatus illustrated in FIG. 1 is operated in the following manner:

While respective portions of the strip 12 are located between the jaws of the two clamping devices 4, 8, the switch 46 remains normally open and the switch 37 closed, and the valves 33, 34 remain in the illustrated positions. The springs 13, 14 initially hold the jaws 5, 6 in the strip-releasing position and the jaws 9, 10 in the strip-clamping position. No longitudinal forces are exerted on the strip 12 while the disk 42 starts turning clockwise from the illustrated position and the piston 27 drives liquid out of the pump 15 through the valve 33 into the compartments 17, 20. The spring 13 being weaker than the spring 14, and the exposed face of the piston 16 in the compartment 17 being larger than the face of the piston 19 in the compartment 11, the jaws 5, 6 grip the strip 12 for a brief instance before it is released by the jaws 9, 10 as the liquid pressure in the two clamping devices is built up by the pump 15. The strip 12, released by the stationary jack 8, is fed forward by the jack 7 moving toward the left, as viewed in the drawing, with the slide 1.

As the slide 1 reaches the abutment 3, the piston 27 starts drawing liquid from the compartments 17, 20, and the spring 14 clamps the stationary jaws 9, 10 on the strip 12 a fraction of a second before the piston rod 6 is withdrawn from the strip inward of the cylinder 7, and the slide 1 reverses its direction of movement. The flexible hose 18' which is secured between two relatively rigid sections of the pipe 18 by means of pipe clamps 40, 41 permits flow of liquid to and from the compartment 17 during movement of the slide 1. The hose 18' is soft enough to prevent the clamping stresses generated between the jaws 5, 6 from being transmitted to the slidably engaged surfaces of the slide 1 and the support 100.

The several metallic elements of the illustrated feeding apparatus are sufficiently resilient to absorb stresses generated during each reversal of slide movement while both jacks 4, 8 simultaneously clamp the strip 12 for a very brief moment. It is possible, though not normally necessary to construct the connecting rod 44 of two telescoping parts spring-biased toward a predetermined overall length, thus capable of expanding and contracting as needed when the slide 1 engages the abutments 2, 3 while the pin 43 still moves in a direction having a component parallel to the path of the slide.

When the feeding apparatus is shut off, as at the end of a working day, the strip 12 is maintained in a precisely defined position by the spring 14, and operation may be resumed next day without any scrap loss from the leading end of the strip 12. For normal, continuous operation, the springs 13, 14 may be dispensed with, and the piston 19 may be moved toward the illustrated position by the pressure of the atmosphere communicating with the cylinder cavity below the piston 19 when the suction of the pump 15 generates a vacuum in the compartment 11. Correspondingly, the returning function of the spring 13 may be assumed by gravity acting on the piston 16. The necessary dimensions and other parameters of the modified clamping devices will readily suggest themselves to those skilled in the art.

When it is desired to switch from one type of strip material to another, the switch 46 is closed while the jaws 9, 10 are held apart by the pressure of liquid in the compartment 11. The energized solenoid of the valve 34 holds the jaws 9, 10 in the strip-releasing position, while the valve 33 permits the pressure fluid to be drained from the compartment 17 to the sump 29, and the strip 12 to be released by the jaws 5, 6. The strip 12 may then be exchanged against other material, and production resumed with only minimal downtime due to the changeover.

The feeding apparatus of the invention partly illustrated in FIG. 2 differs from that described above with reference to FIG. 1 in its structure only to the extent specifically shown and described, and it operates in practically the same manner. The springs 13, 14 are dispendsed with, and the compartments 58, 59, corresponding to those which receive the springs in the embodiment illustrated in FIG. 1, are made fluid tight.

A resilient, fluid-tight membrane 52 is clamped between the two flanged halves of a spherical pressure tank 51. The cavity 53 of one half is filled with compressed air that may be replenished as needed through a valve 60. The cavity 54 of the other half is filled with oil or other hydraulic fluid and communicates with the compartments 58, 59 through a common throttling valve 55 and respective branch lines 56, 57, the air pressure in the tank portion 53 thus is transmitted to the smaller annular face of the piston 16 to exert a smaller force than that exerted by the same air pressure on the circular face of the piston 19 in the compartment 59, the resulting mode of operation being closely analogous to that provided by the springs 13, 14 of different strengths described with reference to FIG. 1.

Other modifications of the illustrated and described feeding apparatus of the invention will readily suggest themselves to those skilled in the art. It should be understood, therefore, that the foregoing disclosure relates only to preferred embodiments of the invention, and that it is intended to cover all changes and variations of the examples of the invention herein chosen for the purpose of the disclosure which do not constitute departures from the spirit and scope of the invention set forth in the appended claims.

What is claimed is:

1. Feeding apparatus for feeding continuous, elongated material in a longitudinal path in sequential steps comprising:

(a) a support;

(b) a slide mounted on said support for reciprocating movement in a predetermined direction;

(c) two clamping devices spaced on said support in said direction, each device including a base portion and an operating portion movable relative to the base portion between two terminal position, (1) one of said portions including a cylinder member enclosing a cavity therein, and the other portion including a piston member movable in said cavity and bounding a compartment of said cavity, (2) said members being secured to respective clamping jaws positioned for clamping said material therebetween in one terminal position of said operating portion and for releasing said material in the other terminal position of said operating portion;

(d) common pressure fluid supply means connected to said compartments for cyclically supplying pressure fluid to said compartments and for simultaneously shifting the operating portion of one of said clamping devices into said one terminal position thereof and the operating portion of the other clamping device into said other terminal position thereof by the pressure of the supplied fluid;

(e) first return means responsive to a decrease in the pressure of said fluid to a first value for shifting the operating portion of said one clamping device from said one terminal position toward the other terminal position;

(f) second return means responsive to a decrease in the pressure of said fluid to a second value different from said first value for shifting the operating portion of said other clamping device from said other terminal position toward said one terminal position thereof;

(g) fastening means fastening the base portion of a first one of said clamping devices to said slide for reciprocating movement therewith, the base portion of the second clamping device being secured to said support against movement with said first fastening device; and (h) actuating means for actuating said reciprocating movement and for varying said pressure in timed sequence.

2. Apparatus as set forth in claim 1, wherein said second clamping device is said other clamping device.

3. Apparatus as set forth in claim 2, further comprising an abutment in said cavity of said other clamping device and defining said other terminal position of the operating portion of said other clamping device.

4. Apparatus as set forth in claim 2, wherein said pressure fluid supply means include a source of fluid under pressure, a first conduit communicating with said source and the cavity of said first clamping device, two-way valve means in said conduit for alternatively connecting the cavity of said first clamping device to said source and to a sump, a second conduit communicating with said source and the cavity of said second clamping device, shut-off valve means in said second conduit, and operating means for operating each of said valve means.

5. Apparatus as set forth in claim 4, wherein said operating means include an electromagnetic actuator for each of said valve means, and switch means for simultaneously energizing said actuators.

6. Apparatus as set forth in claim 2, wherein said pressure fluid supply means include a source of fluid under super atmospheric pressure, a conduit communicating with said source and the cavity of said first clamping device, and two-way valve means in said conduit for alternatively connecting the cavity of said first clamping device to said source and to a sump.

7. Apparatus as set forth in claim 2, wherein said second value is greater than said first value.

8. Apparatus as set forth in claim 1, wherein said pressure fluid supply means include a pump cylinder having an axis, a piston axially reciprocable in said cylinder, and rotary cam means for axially moving said piston in said cylinder, said actuating means including common drive means for simultaneously rotating said cam means and for reciprocating said slide.

9. Apparatus as set forth in claim 1, wherein at least one of said return means includes a spring interposed between the portions of the associated clamping device for shifting the associated operating portion between said positions thereof.

10. Apparatus as set forth in claim 1, wherein at least one of said return means includes a source of a fluid under permanent, super atmospheric pressure, the associated piston member separating said compartment from another compartment of said cavity, said other compartment communicating with source source.

* * * * *